US008319698B2

(12) United States Patent
Legay et al.

(10) Patent No.: US 8,319,698 B2
(45) Date of Patent: Nov. 27, 2012

(54) REFLECTOR ARRAY AND ANTENNA COMPRISING SUCH A REFLECTOR ARRAY

(75) Inventors: Hervé Legay, Plaisance du Touch (FR); Danièle Bresciani, Toulouse (FR); Renaud Chiniard, Mourvilles-Basses (FR); Etienne Girard, Tournefeuille (FR)

(73) Assignee: Thales, Neuilly-sur-Siene (FR)

( * ) Notice: Subject to any disclaimer, the term of this patent is extended or adjusted under 35 U.S.C. 154(b) by 511 days.

(21) Appl. No.: 12/573,499

(22) Filed: Oct. 5, 2009

(65) Prior Publication Data

US 2010/0085272 A1 Apr. 8, 2010

(30) Foreign Application Priority Data

Oct. 7, 2008 (FR) ..... 08 05530

(51) Int. Cl.
*H01Q 15/14* (2006.01)

(52) U.S. Cl. ..... 343/913

(58) Field of Classification Search ..... 343/912–915
See application file for complete search history.

(56) References Cited

U.S. PATENT DOCUMENTS

| | | | | |
|---|---|---|---|---|
| 4,905,014 | A | 2/1990 | Gonzalez et al. | |
| 5,543,809 | A * | 8/1996 | Profera, Jr. | 343/753 |
| 6,384,797 | B1 * | 5/2002 | Schaffner et al. | 343/795 |
| 6,396,449 | B1 * | 5/2002 | Osterhues et al. | 343/754 |
| 6,538,621 | B1 * | 3/2003 | Sievenpiper et al. | 343/909 |
| 6,670,918 | B2 | 12/2003 | Guiraud et al. | |
| 6,927,729 | B2 | 8/2005 | Legay | |
| 7,042,397 | B2 | 5/2006 | Charrier et al. | |
| 7,142,164 | B2 | 11/2006 | Legay et al. | |
| 7,154,451 | B1 * | 12/2006 | Sievenpiper | 343/909 |
| 7,358,915 | B2 | 4/2008 | Legay et al. | |
| 7,362,284 | B2 | 4/2008 | Legay et al. | |
| 7,719,463 | B2 * | 5/2010 | Migliaccio et al. | 342/188 |
| 7,872,614 | B2 * | 1/2011 | Gonzalez et al. | 343/915 |
| 7,920,100 | B2 * | 4/2011 | Brown et al. | 343/818 |
| 2003/0058189 | A1 | 3/2003 | Crouch et al. | |
| 2007/0268192 | A1 | 11/2007 | Legay et al. | |
| 2008/0024368 | A1 | 1/2008 | Chang et al. | |

FOREIGN PATENT DOCUMENTS

| | | | |
|---|---|---|---|
| EP | 1 796 450 | A1 | 6/2007 |
| WO | WO 2008/080894 | A1 | 7/2008 |

OTHER PUBLICATIONS

Jose A. Encinar, "Design of Two-Layer Printed Reflectarrays Using Patches of Variable Size", IEEE Transactions on Antennas and Propagation, Oct. 2001, pp. 1403-1410, vol. 49—No. 10, IEEE Service Center, Piscataway, NJ, US.

Kokusho Sha et al., "Characteristics of New Types of Quasi-Optical Diplexers", Electronics and Communications in Japan: Part I: Communications, Dec. 1986, pp. 90-99, vol. 69—No. 12, Wiley, Hoboken, NJ, US.

* cited by examiner

*Primary Examiner* — Huedung Mancuso
(74) *Attorney, Agent, or Firm* — Baker & Hostetler LLP

(57) ABSTRACT

A reflector array comprises a plurality of individual radiating elements forming a reflecting surface with no abrupt transitions wherein each radiating element of the reflecting surface is selected from a set of predetermined consecutive radiating elements, called the pattern, the first and last elements of the pattern correspond to one and the same phase, modulo 360°, and are identical, and the radiating elements of the pattern have a radiating structure, of metal patch type and/or of radiating aperture type, that progressively changes from one radiating element to another adjacent radiating element, the change in the radiating structure comprising a succession of progressive growths of at least one metal patch and/or at least one aperture and appearances of at least one metal patch in an aperture and/or at least one aperture in a metal patch.

22 Claims, 7 Drawing Sheets

REFLECTOR ARRAY AND ANTENNA COMPRISING SUCH A REFLECTOR ARRAY

CROSS-REFERENCE TO RELATED APPLICATIONS

This application claims priority of French application no. FR 0805530, filed Oct. 7, 2008, the disclosure of which is hereby incorporated by reference in its entirety.

FIELD OF THE INVENTION

The present invention relates to a reflector array for a reflector array antenna. It applies notably to antennas mounted on a spacecraft such as a telecommunication satellite or to the antennas of terrestrial terminals for satellite telecommunication or broadcasting systems.

BACKGROUND OF THE INVENTION

A reflector array (or "reflectarray") antenna 10, as represented for example in FIG. 1, comprises a set of individual radiating elements 12 assembled in a one- or two-dimensional array 11 and forming a reflecting surface 14 making it possible to increase the directivity and the gain of the antenna 10. The individual radiating elements, also called individual cells, of the reflector array, of metal patch and/or slot type, have variable parameters, such as, for example, the geometric dimensions of the etched patterns (length and width of the patches or of the slots) which are set so as to obtain a selected radiation pattern. As shown for example in FIG. 2, the individual radiating elements 12 can consist of metal patches filled with radiating slots and separated from a metal ground plane by a typical distance of between $\lambda g/10$ and $\lambda g/6$, in which $\lambda g$ is the guided wavelength in the spacing medium. This spacing medium may be a dielectric, but also a composite sandwich produced by a symmetrical lay-out of a bees nest type separator and of dielectric skins of fine thicknesses. For the antenna 10 to be efficient, it is essential for the individual cell to be able to accurately control the phase shift that it produces on an incident wave, for the different frequencies of the bandwidth. The method of manufacturing the reflector array must also be as simple as possible.

The lay-out of the radiating elements in the reflector array requires great attention. It should observe, at least approximately, a strong periodicity which defines the reflection characteristics of the reflector array (typically less than $0.65\lambda$ and preferably equal to $0.5\lambda$, in which $\lambda$ is the wavelength in free space). As explained below, the greater the periodicity, the better the efficiency. However, the reflector arrays that are currently known present a major problem.

The lay-out of the individual radiating elements relative to one another to form a reflector array is synthesized so as to obtain a given radiation pattern in a pointing direction that is selected to produce a given coverage. FIG. 3*a* shows an exemplary arrangement of the radiating elements of a reflector array antenna according to the prior art, making it possible to obtain a directional beam pointed in a lateral direction relative to the antenna. Because of the flatness of the reflector array and because of the differences in the path lengths of a wave emitted by a primary feed 13 to each radiating element of the array, the illumination of the reflector array by an incident wave originating from a primary feed 13 produces a phase distribution of the electromagnetic field above the reflecting surface. The dimensions of the radiating elements are therefore defined so that the incident wave is reflected by the array 11 with a phase shift that compensates the relative phase of the incident wave. The radiating elements 12 are therefore not all surrounded by similar elements, and the transitions from one radiating element to another are greater the faster the phase variation.

As a result of this, there are two problems: firstly, the standard approximation which consists in calculating the electrical characteristics of the radiating elements assuming an infinite periodicity is no longer valid for these elements. Also, a diffraction phenomenon appears in these areas where the pseudo-periodicity of the arrangement of the individual radiating elements 12 is broken. Although the amplitude of the electric field is assumed to follow an apodized distribution related to the width of the beam from the primary feed 13, the measured distribution of the radiated electric field above the reflector array 11 as a whole exhibits areas in which it is damped, which correspond precisely to the location of these strong transitions. The greater the mesh size of the reflector array, the greater this diffraction becomes. This causes an increase in the level of the secondary lobes which, even it remains less than −20 dB, creates a degradation of the directivity of the associated antenna 10 which is unacceptable for a telecommunication antenna.

SUMMARY OF THE INVENTION

The aim of the present invention is to remedy these drawbacks by proposing a reflector array that does not introduce strong breaks in the periodicity of the radiating elements on the reflecting surface and thus makes it possible to reduce the disturbances in the radiation pattern and enhance the directivity of the array antenna comprising such a reflector array.

Another aim of the invention is to propose a reflector array that makes it possible to reduce the number of transitions while increasing the possibilities of varying the phase of the waves reflected by the radiating elements.

A final aim of the invention is to propose a reflector array comprising individual radiating elements that have a simple and compact radiating structure.

To this end, the subject of the invention is a reflector array comprising a plurality of individual radiating elements arranged alongside one another and forming a reflecting surface with no abrupt transitions and capable of reflecting incident waves with a phase variation law selected to provide a given coverage, characterized in that:

- the individual radiating elements are produced using planar technology,
- each radiating element of the reflecting surface is selected from a set of predetermined consecutive radiating elements, called the pattern, the pattern being capable of creating a progressive phase variation of at least 360° between a first element and a last element of the pattern,
- the first and last elements of the pattern correspond to one and the same phase, modulo 360°, and are identical,
- the radiating elements of the pattern have a radiating structure, of metal patch type and/or of radiating aperture type, that progressively change from one radiating element to another adjacent radiating element, the change in the radiating structure comprising a succession of progressive growths of at least one metal patch and/or at least one aperture and appearances of at least one metal patch in an aperture and/or at least one aperture in a metal patch.

For example, the aperture may be an annular slot having an electrical length that increases progressively from one radiating element to another adjacent radiating element and the metal patch may be a metal ring having a width that changes from one radiating element to another adjacent radiating element.

According to one embodiment, the pattern comprises:

several consecutive first radiating elements comprising a metal ring delimiting an internal aperture in which the width of the metal ring increases progressively from one radiating element to another adjacent radiating element until a complete metal patch is obtained, and several second consecutive elements comprising an internal metal patch and at least one annular slot in which the width of the annular slot increases progressively from one radiating element to another adjacent radiating element until the internal metal patch disappears and a metal ring is obtained.

Advantageously, the pattern may comprise at least one radiating element comprising at least one metal patch and two concentric annular slots formed in the metal patch.

Advantageously, the pattern may comprise several radiating elements comprising a metal patch and several concentric annular slots formed in the metal patch, at least one of the annular slots of a radiating element having an electrical length that changes relative to another adjacent radiating element.

Advantageously, the pattern may comprise a radiating element comprising a complete metal patch and several consecutive radiating elements comprising a metal patch and several concentric annular slots formed in the metal patch, the annular slots having a length that changes independently or simultaneously from one radiating element to another adjacent radiating element.

Advantageously, the pattern may comprise at least one radiating element including an annular slot or several concentric annular slots and at least one short circuit means and/or capacitive means placed in at least one annular slot, the short circuit means and/or the capacitive means causing the electrical length of the slot to vary.

The short circuit means can be a metallization dividing up the slot at one point and over a predetermined length or a microswitch.

Advantageously, each radiating element of the pattern may include at least one microswitch, each microswitch being positioned in an annular slot at a predetermined point and in a selected open or closed state, all the annular slots having the same width.

Advantageously, the pattern may comprise several consecutive radiating elements including several concentric annular slots, all the radiating elements comprising the same number of microswitches positioned at the same points in the annular slots, the microswitches of all the radiating elements of the pattern being configured in different states, and the states of the microswitches varying progressively from one radiating element to another adjacent radiating element.

Preferably, the radiating elements have a geometrical shape selected from a hexagon shape and a cross shape with two perpendicular branches.

The invention also relates to a reflector array antenna comprising at least one reflector array.

BRIEF DESCRIPTION OF THE DRAWINGS

Other features and benefits of the invention will become clearly apparent from the following description given by way of purely illustrative and nonlimiting example, with reference to the appended diagrammatic drawings which represent.

DETAILED DESCRIPTION

Figure 1:
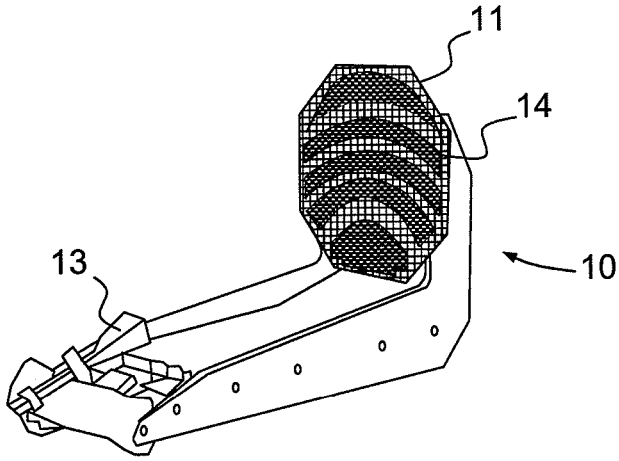
FIG. 1: a diagram of an exemplary reflector array antenna.

FIG. 1 shows an example of a reflector array antenna comprising an optimized reflector array 11, as described below, forming a periodic reflecting surface 14 and a primary feed 13 to illuminate the reflector array 11 with an incident wave.

Figure 2:
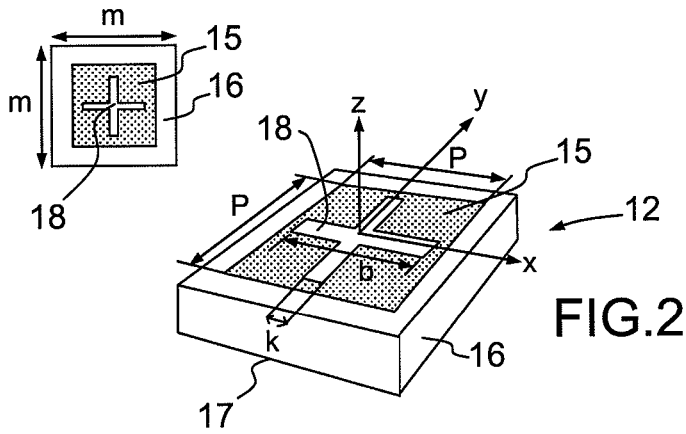
FIG. 2: a diagram of an exemplary individual radiating element produced using planar technology.

FIG. 2 shows an example of a square shaped individual radiating element 12 that has sides of length m, comprising a metal patch 15 printed on a top surface of a dielectric substrate 16 provided with a metal ground plane 17 on its bottom face. The metal patch 15 has a square shape with sides of dimension p and includes two slots 18 of length b and of width k formed in its centre, the slots being arranged in the shape of a cross. In a three-dimensional coordinate system XYZ, the plane of the reflecting surface of the radiating element is the plane XY. The shape of the individual radiating elements 12 is not limited to a square; it can also be rectangular, triangular, circular, hexagonal, in the shape of a cross, or any other geometrical shape. The number of the slots produced can also be different from two and the arrangement of the slots may differ from a cross.

Figure 3A:
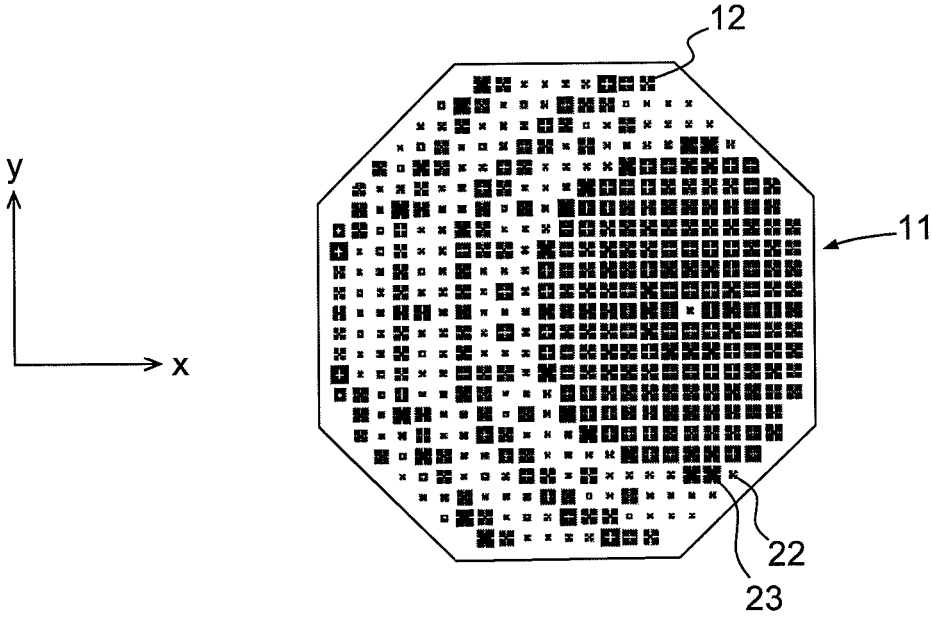
FIG. 3*a*: a diagram of an exemplary arrangement of the radiating elements of a reflector array, according to the prior art.
Figure 3B:
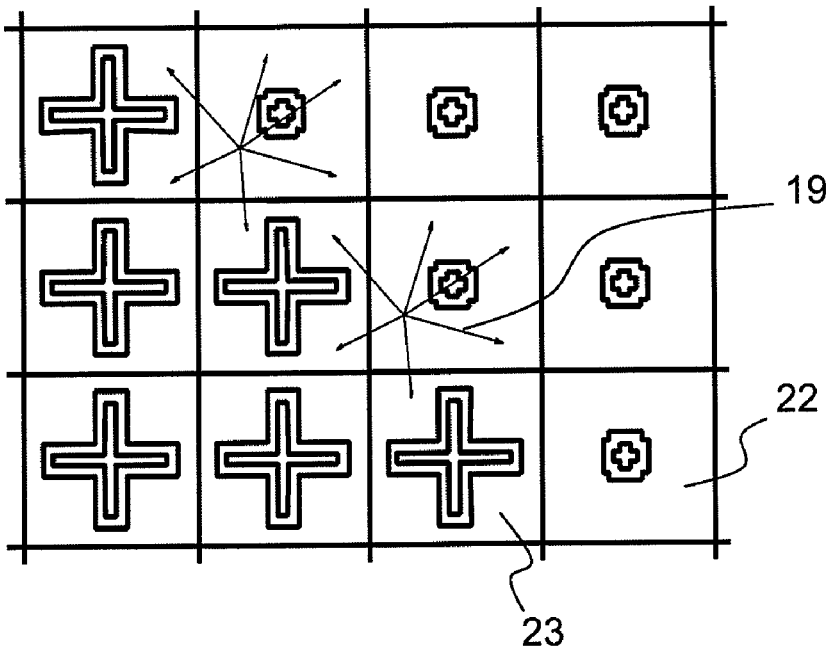
FIG. 3*b*: an enlarged view of an example of abrupt break in the periodicity of a reflector array, according to the prior art.
Figure 4:
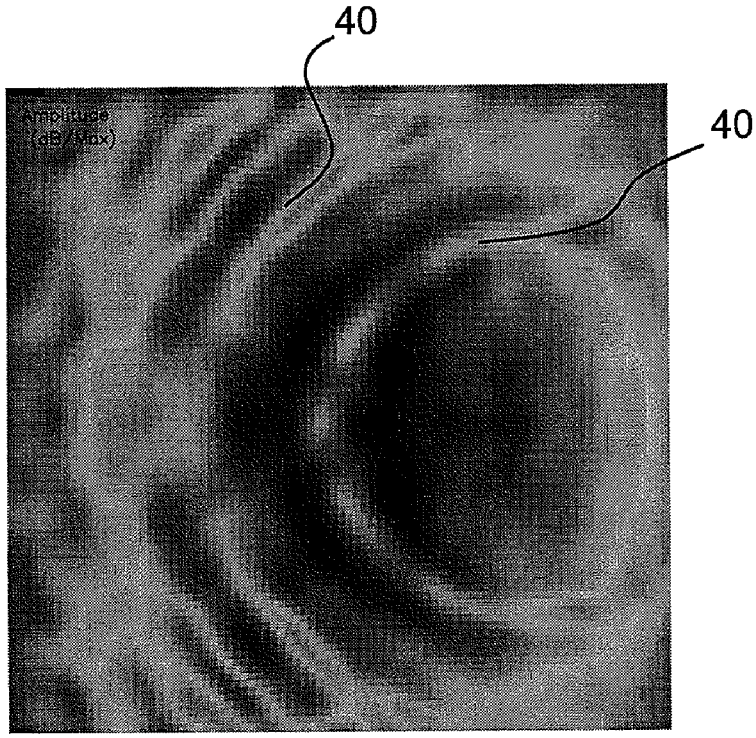
FIG. 4: an example of attenuations of the radiated electromagnetic field above the radiating surface of the array antenna of FIG. 3*a;*

FIG. 3*a* shows an example of an arrangement of the radiating elements of a reflector array antenna, according to the prior art. In this figure, radiating elements 12 similar to those of FIG. 2 but having variable metal patch 15 dimensions are arranged as a reflector array 11 comprising abrupt breaks in periodicity. FIG. 3*b* is an enlarged view of an example of abrupt break in periodicity. In practice, some adjacent radiating elements, such as the elements 22 and 23, are very different from one another. At the transitions between two very different adjacent radiating elements, there is a discontinuity which induces a diffraction 19 of the radiation reflected by the reflector array and an attenuation of the radiated electromagnetic field above the radiating surface. FIG. 4 shows the attenuations 40 of the electromagnetic field obtained with the reflector array of FIG. 3*a*. This FIG. 4 shows that there is a very clear correlation between the breaks in periodicity of the radiating surface of FIG. 3*a* and the attenuations of the radiated electromagnetic field above this surface. This arrangement gives a disturbance radiation pattern with an increase in the level of the secondary lobes and does not make it possible to obtain a good directivity of the antenna comprising this reflector array.

Figure 5:
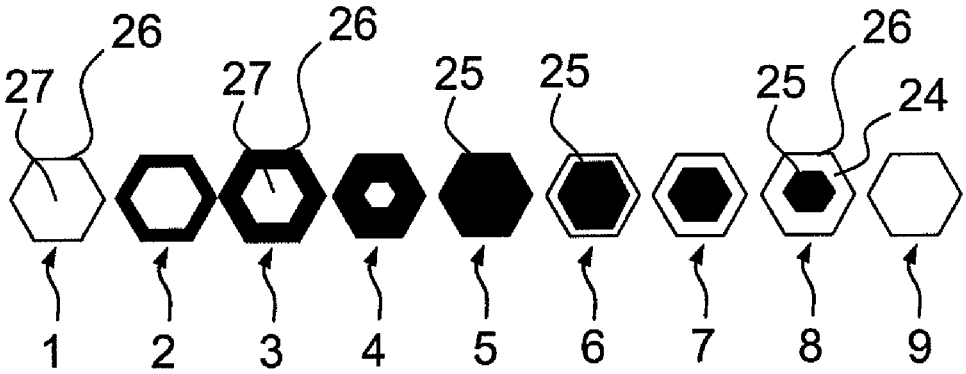
FIG. 5: a diagram of an example of a periodic pattern comprising a one-dimensional arrangement of several individual radiating elements and making it possible to obtain a phase rotation of 360°, according to the invention.

FIG. 5 represents an example of a semi-periodic pattern comprising a one-dimensional arrangement of several individual radiating elements and making it possible to obtain a phase rotation of 360°, according to the invention. In this example, the geometrical shape of the radiating elements is hexagonal and their peripheral circumferential dimension is identical. They are produced using planar technology and their radiating structure is no more complex than that of the radiating elements represented in FIG. 2, but said radiating structure changes progressively from one radiating element to an adjacent radiating element, in the plane of the reflecting surface 14, and does not therefore exhibit any abrupt break between two adjacent radiating elements. The first 1 and the last 9 radiating elements are identical. This makes it possible to produce a 360° phase variation loop since the final state is identical to the initial state.

In this example, the first element 1 comprises a peripheral circumferential metal ring 26 delimiting an internal cavity 27. The next three consecutive elements 2, 3, 4 also comprise a peripheral circumferential metal ring 26 delimiting an internal cavity 27, the width of the ring increasing progressively from one radiating element to a second radiating element immediately adjacent until the fifth element 5, placed in the centre of the pattern, which is a complete metal patch 25, is obtained. From the sixth element 6, an annular slot 24, for example hexagonal when the radiating elements have a hexagonal shape, is introduced in the vicinity of the periphery of the internal metal patch 25 and a circumferential metal ring 26 is left at the periphery. The next consecutive radiating elements 7, 8 have a hexagonal slot 24, the width of which increases progressively until the internal metal patch 25 disappears like the radiating element 9. Instead of altering the width of the slot, it is also possible to alter the length of the slot or to load the slot with capacitive loads. A modification of the width or length of the slot, or the addition of a capacitive load, has the effect of modifying the propagation characteristics of the waves in the slot and of affecting the electrical length of the slot. As a reminder, the electrical length of a slot corresponds to the ratio of its physical length to the wavelength that is propagated therein.

When the radiating element is a complete metal patch 5, an incident wave originating from a primary feed 13 which eliminates this radiating element is completely reflected by the patch. When the metal patch has an aperture, such as a slot for example, a resonant cavity is formed between the metal patch and the metal ground plane. A portion of the incident wave illuminating this radiating element is then transmitted to the metal ground plane of the radiating element which reflects the incident wave with a phase shift. The aperture therefore introduces a phase shift into the wave reflected by the radiating element, the magnitude of which is greater the larger the aperture. Compared to a radiating element comprising a complete patch, the maximum phase shift is obtained when the radiating element 1, 9 no longer includes a metal patch but only a thin metal ring delimiting a resonant cavity.

With a complete phase variation cycle such as that shown in FIG. 5, it is possible to obtain a phase shift greater than 360°. For this, all that is required is to repeat the same pattern of variation of the structure of the radiating element several times. The number of radiating elements to produce a pattern may differ from that of FIG. 5, but there must be enough of them not to create any abrupt break in the periodicity of the reflecting surface 14. To obtain additional phase variation possibilities and further limit the number of abrupt transitions in the reflector array, it is also possible to add one or more additional radiating elements to the pattern shown in FIG. 5.

Figure 6:
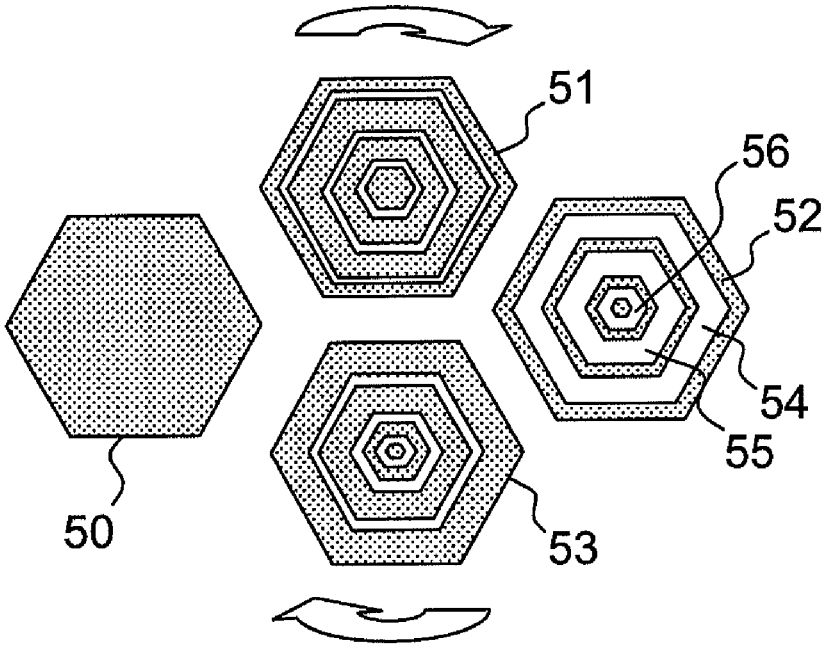
FIG. 6: a diagram of an example of individual radiating elements, comprising several slots of changing widths, according to the invention.

Several slots can be produced in the metal patch of the radiating elements so as to obtain several resonators coupled by individual radiating elements as shown in FIG. 6. In this example, a first element 50 consists of a complete metal patch, and each of the next three radiating elements 51, 52, 53 comprises three concentric hexagonal slots 54, 55, 56 formed in a metal patch. The width of the slots, in the plane of the reflecting surface 14, increases between the second 51 and the third 52 elements; then the width of the metal areas increases between the third 52 and the fourth 53 elements. The radiating elements, of which there are four in FIG. 6, can be arranged in the pattern shown in this example, this pattern being able to be reproduced recursively over the entire reflecting surface 14. The frequency of the incident wave determines which of the three slots of the patch resonates. In the example of FIG. 6, the widths of the three slots change simultaneously, but the invention is not limited to such a case. It is also possible to produce a pattern comprising radiating elements in which the slots have widths that change independently of one another and/or radiating elements in which only one or two slots have a width that changes from one radiating element to another adjacent radiating element.

The benefit of radiating elements that include several slots in a metal patch is that they make it possible to obtain a progression in the phase variation that is more sophisticated than with elements that have only a single slot. They make it possible to obtain a range of phase variation of up to 1000°, and reduce the number of transitions. In the cases described above, the radiating elements have a hexagonal shape, but the same principle can be used for all types of geometrical shapes, such as, for example, a square, rectangular, circular, triangular shape, or a cross or any other shape.

Alternatively, it is possible to combine, in one and the same pattern, radiating elements that do not include any slot and radiating elements that include one or more slots. By progressively introducing the slots into the consecutive radiating elements, it is possible to further reduce the number of transitions and further widen the range of phase variation of the waves reflected by the radiating elements of a pattern.

It is also possible, as an alternative embodiment of the invention, for radiating elements that comprise at least one slot to progressively introduce one or more short circuits as described above in conjunction with FIG. 7 or later in conjunction with FIG. 8.

Figure 7:
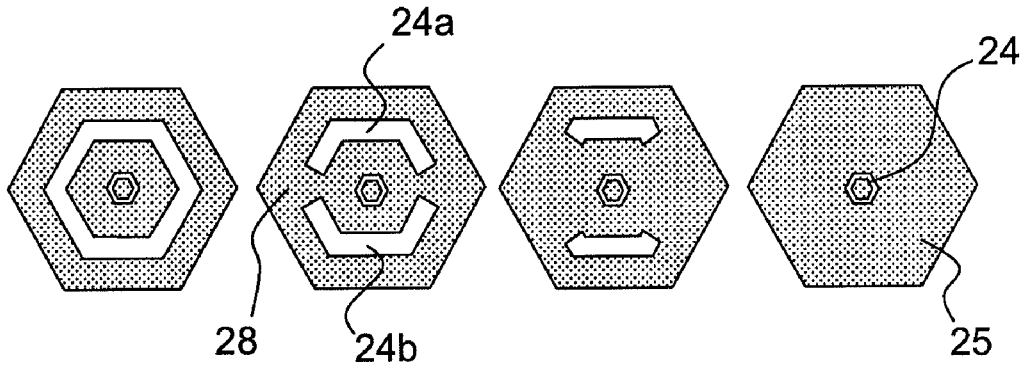
FIG. 7: a diagram of an example of individual radiating elements comprising at least one slot and at least one short circuit according to the invention.

In FIG. 7, radiating elements comprise a patch 25 and a slot 24, or several slots, into which are introduced one or more short circuits 28 making it possible to cause the electrical length of the slot to vary. The short circuits 28 can be of passive type when they comprise a simple metallization dividing up the slot 24 at a point and over a predetermined length to obtain at least two half-slots 24*a* and 24*b* of selected lengths. Alternatively, the short circuits can be of active type when they are produced by means of microswitches, for example of MEMS (microelectro-mechanical system) type or diodes. The addition of the short circuits 28 placed in a slot 24 of an individual radiating element thus makes it possible to produce several resonators on the same individual radiating element, and thus increase the possibilities of phase variation and further reduce the number of abrupt transitions.

It is possible, in one and the same radiating element and/or in two or more different radiating elements of one and the same pattern, to combine slots that have one or more active short circuits and slots that have one or more passive short circuits. All possible combinations can be considered in the framework of the present invention.

The use of these radiating elements with multiple resonators coupled together in a reflector array therefore makes it possible to considerably reduce the number of abrupt transitions in the reflector array and correspondingly reduce the disturbances induced in the radiation pattern. Another benefit is that, with an increased number of degrees of freedom, it is possible to guarantee the required phase shift not only at the centre frequency, but also at several other frequencies of the passband of the reflector array.

Figure 8A:
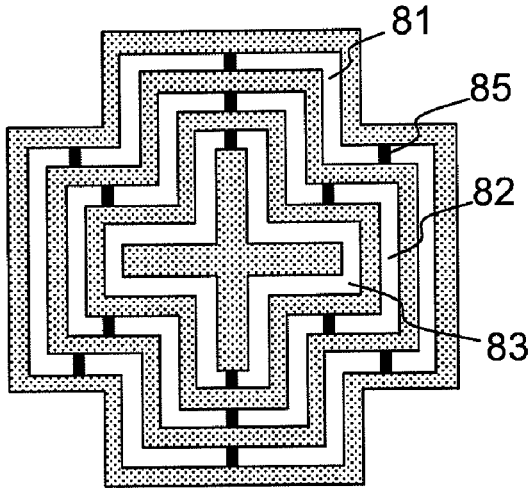
FIG. 8*a*: an example of a radiating element comprising MEMS, according to the invention.

FIG. 8*a* shows an example of a radiating element in the shape of a cross with two perpendicular branches. The cross and the hexagon have the property of being miniature because the slots that determine the resonance are curved. This makes it possible to insert several separator resonators on the metal patch and with four slots for example, it is possible to cause the phase to vary up to 1000° without creating strong transitions.

In FIG. 8*a*, the cross comprises three concentric annular slots 81, 82, 83 formed in a metal patch, but it could comprise a number thereof other than three. In the same way as for the hexagon, it is possible to progressively control the variation of the phase over a reflecting surface, by arranging several radiating elements in the shape of a cross and having variable slot widths or metal ring widths.

Figure 8B:
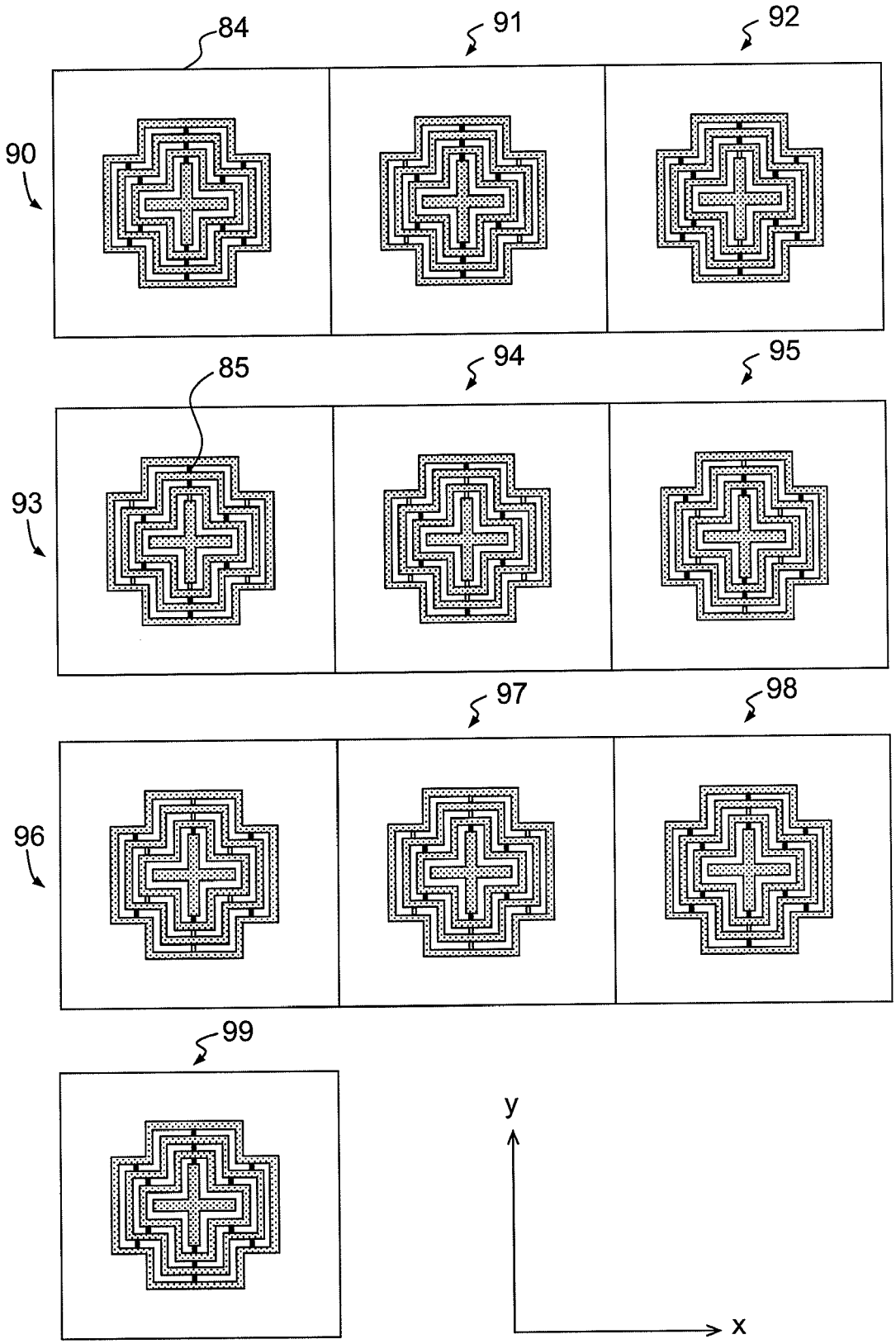
FIG. 8*b*: an example of a periodic pattern consisting of several radiating elements in the shape of a cross provided with three concentric annular slots and MEMS in each slot, according to the invention.

As shown in FIG. 8*b*, to obtain abutting radiating elements, each cross can, for example, be inscribed within a continuous metal grating 84 having mesh cells of a different geometrical shape, for example square, rectangular or hexagonal. Alternatively, instead of having the geometry of the slots vary, it is possible to have the phase vary by using microswitches, for example of MEMS (microelectro-mechanical system) type 85, or other switching systems such as diodes, arranged in a selective manner in the slots as represented, for example, in FIGS. 8*a* and 8*b*. In this case, all the radiating elements have the same structure and all the annular slots have the same width. The MEMS 85 placed in the slots 81, 82, 83 have two possible states, open or closed, and act as short circuit or as open circuit. They can also act as a variable capacitive charge in the case of capacitive MEMS. They thus make it possible to vary the electrical length of the slots, and therefore the phase of a wave reflected by each radiating element. In the same way as for the radiating elements with variable slot widths, it is then possible to control the phase of the radiating elements by placing, in a predetermined manner, for example in the most active areas where the electromagnetic field is strongest, certain MEMS in the closed state and other MEMS in the open state according to the desired phase shift law. Thus, for example, it is possible to produce a pattern with progressive phase variation that does not include abrupt transitions, by using several radiating elements that have the same geometry, the same number of MEMS positioned at the same point in the annular slots, but MEMS configured in different states. For example, with a pattern comprising several radiating elements in the shape of a cross or hexagon, provided with three concentric annular slots and MEMS in each slot, it is possible to have the phase vary progressively up to 1000° by progressively short circuiting the different slots of the adjacent radiating elements until a radiating element is obtained that has all its MEMS in the closed state, and then, over several additional adjacent elements, to progressively set the MEMS to the open state until a radiating element that has all its MEMS in the open state is obtained. It is also possible to pair certain MEMS together and group them together in one and the same command to have their open or closed state vary at the same time. This may make it possible, for example in the case of a cross-shaped geometry with two perpendicular branches, to retain a mirror symmetry about the two axes X and Y of the two branches of the cross and avoid exciting radiation modes of an order greater than the main mode that are likely to generate crossed polarization and reduce the bandwidth of the reflector array.

In the examples shown in FIG. 8*b*, the pattern comprises ten identical radiating elements in the shape of a cross comprising three concentric annular slots and having the same number of MEMS, in this case two MEMS paired on the Y axis, in the first innermost slot, six MEMS in the second slot and six MEMS in the third outer slot. The six MEMS of the second slot, and the six MEMS of the third slot, have two pairs on the Y axis and the other four MEMS are paired together. In the first radiating element 90, all the MEMS are in a closed state. In the second radiating element 91, the four MEMS of the third slot that are paired together are in an open state, all the other MEMS being in a closed state. In the third radiating element 92, the two MEMS of the first slot are in the open state and all the other MEMS are in the closed state. The following radiating elements 93 to 98 comprise other combinations of states of the different MEMS as far as the last radiating element 99 of the pattern, in which all the MEMS are in the same closed state as the first radiating element of the pattern. Such a pattern makes it possible to vary the phase of the radiating elements over 360°.

The geometry of the radiating element of FIGS. 8*a* and 8*b* is a cross shape, but it is alternatively possible to place MEMS in radiating elements that have another geometry such as a hexagonal, square or rectangular shape, or any other desired shape.

A cross-shaped or hexagonal shaped radiating element has the benefit of being very compact and therefore wideband. As the number of annular slots, and therefore of resonators, increases, the more compact the radiating element becomes, and the greater its bandwidth. In particular, a cross-shaped radiating element makes it possible to obtain an antenna that operates between 11 and 14 GHz. Furthermore, a cross shape offers the benefit of being compatible with a square or rectangular mesh, which simplifies the production of a panel comprising a reflector array consisting of radiating elements having this cross shape.

Alternatively, it is also possible to combine, in one and the same pattern, radiating elements that have one or more slots of changing width and radiating elements that have one or more slots that have a changing electrical length, and radiating elements that have at least one slot of changing electrical length may comprise radiating elements including at least one passively short circuited slot and/or radiating elements that have at least one actively short circuited slot and/or radiating elements that include at least one slot incorporating capacitive MEMS.

Figure 9:
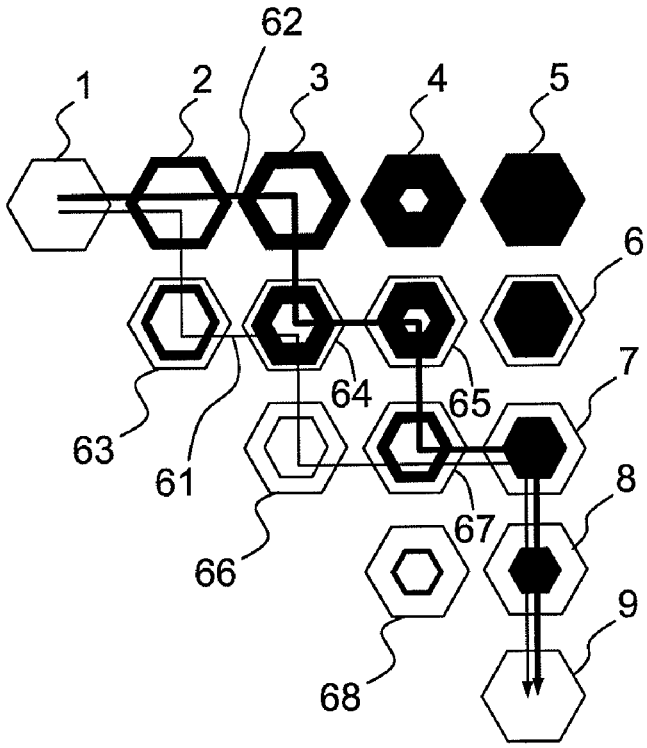
FIG. 9: a diagram of an example of a two-dimensional database comprising arrangements of several individual radiating elements of different structures and two examples of possible variation paths making it possible to obtain a phase rotation of 360°, according to the invention.
Figure 11:
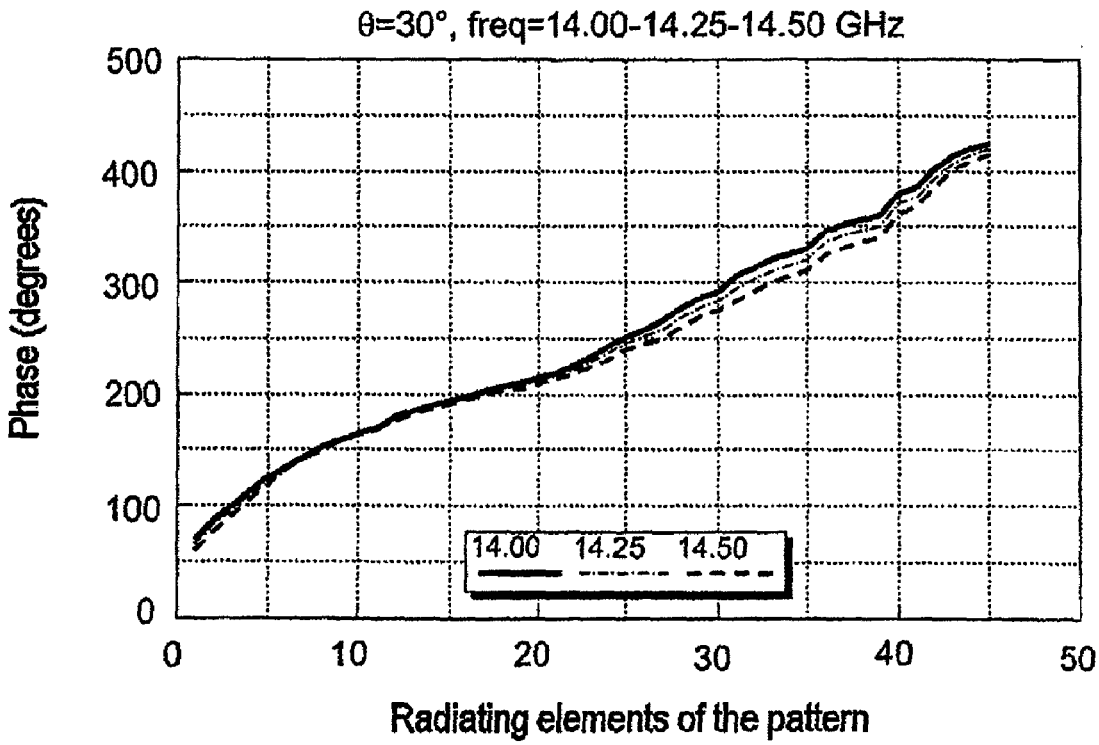
FIG. 11: an example of a phase variation corresponding to the two variation paths of FIG. 9, according to the invention.

To produce a two-dimensional arrangement making it possible to obtain a selected phase variation law without creating abrupt breaks in periodicity, it may be wise to create a database comprising different radiating elements having a changing structure making it possible to obtain a phase variation of 360°, as described above, and arranged in a two-dimensional pattern. FIG. 9 illustrates an example of a database according to the invention. This database comprise the radiating elements 1 to 9 of FIG. 5 and additional radiating elements 63 to 68 that have different intermediate structures. By using this database to correctly select the variation path, it is possible to produce a progressive variation of the phase of a reflected wave, from a progressive physical variation of the radiating elements. In this FIG. 9, different possible paths can be used to obtain a progressive phase variation of 360°. Two examples of paths 61, 62 are shown. An example of phase variation obtained for a variation path, such as the path 61 or 62, selected from the database of FIG. 9, for an angle of incidence of the flat wave e equal to 30° and three different centre frequencies, is shown in FIG. 11. The three frequencies of this example are 14 GHz, 14.25 GHz and 14.50 GHz and the phase variation obtained is between 60° and 420° for a pattern comprising 45 different radiating elements. This FIG. 11 shows a progressive phase variation that includes no abrupt jumps.

The database can be extended to radiating elements that comprise several hexagonal slots. In this case, it becomes possible to produce precisely the desired phase shift for the centre frequency of the radiation pattern of the antenna as well as the desired phase dispersion.

Figure 10:
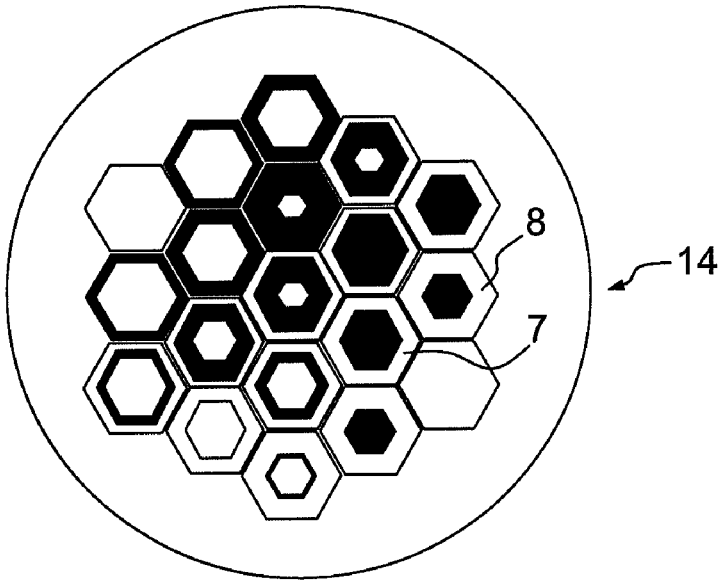
FIG. 10: an example of the layout of the radiating elements for a reflector array of an antenna, according to the invention.

The radiating elements selected to produce a predetermined phase variation can then be arranged in a two-dimensional reflecting array as shown for example in FIG. 10. The reflecting array produced in this way makes it possible to obtain a progressive variation of the phase of the incident waves reflected by the array from a progressive physical variation of the individual radiating elements of the array.

Although the invention has been described in relation to a particular embodiment, it is obvious that it is in no way limited to this and that it includes all technical equivalents of the means described as well as their combinations, provided that the latter fall within the framework of the invention.

What is claimed is:

1. A reflector array comprising a plurality of individual radiating elements arranged alongside one another and forming a reflecting surface capable of reflecting incident waves with a phase variation law selected to provide a given coverage, wherein:

the individual radiating elements are produced using planar technology, each radiating element of the reflecting surface is selected from a set of predetermined consecutive radiating elements, being a pattern, the pattern being capable of creating a progressive phase variation corresponding to a 360° phase cycle between a first element and a last element of the pattern, the 360° phase cycle consists of two successive different, first and second, phase ranges, and the pattern comprises several consecutive first radiating elements having a radiating structure of metal patch type in which the size of the metal patch increases progressively from one radiating element to another adjacent radiating element to obtain a first range of progressive phase variation corresponding to the first phase range of the 360° cycle and several consecutive second radiating elements having a radiating structure of aperture type in which the size of the aperture increases progressively from one radiating element to another adjacent radiating element to obtain a second range of progressive phase variation corresponding to the second phase range of the 360° phase cycle.

2. The reflector array according to claim 1, wherein the first and the last radiating elements of the pattern corresponding to the 360° phase cycle are identical.

3. The reflector array according to claim 1, wherein the pattern comprises at least one radiating element comprising at least one metal patch delimiting an internal aperture.

4. The reflector array according to claim 3, wherein the pattern comprises several consecutive radiating elements comprising at least one metal patch delimiting an internal aperture in which the size of the metal patch increases progressively from one radiating element to another adjacent radiating element until the internal aperture disappears.

5. Reflector array according to claim 3, wherein the pattern comprises at least one radiating element comprising at least one aperture delimiting an internal metal patch.

6. The reflector array according to claim 5, wherein the pattern comprises several consecutive radiating elements comprising at least one aperture delimiting an internal metal patch in which the size of the aperture increases progressively from one radiating element to another adjacent radiating element until the internal metal patch disappears.

7. Reflector array according to claim 1, wherein the pattern comprises at least one radiating element comprising at least one aperture delimiting an internal metal patch.

8. The reflector array according to claim 1, wherein the aperture is an annular slot having an electrical length that changes progressively from one radiating element to another adjacent radiating element.

9. The reflector array according to claim 4, wherein the metal patch is a metal ring having a width that changes from one radiating element to another adjacent radiating element.

10. The reflector array according to claim 6, wherein the pattern comprises:

several consecutive first radiating elements having at least one metal ring delimiting an internal aperture in which the width of the metal ring increases progressively from one radiating element to another adjacent radiating element until the internal aperture disappears, and several consecutive second radiating elements having at least one annular slot delimiting an internal metal patch in which the width of the annular slot increases progressively from one radiating element to another adjacent radiating element until the internal metal patch disappears.

11. The reflector array according to claim 1, wherein the pattern also comprises at least one radiating element comprising at least one metal patch and two concentric annular slots formed in the metal patch.

12. The reflector array according to claim 1, wherein the pattern also comprises several radiating elements comprising a metal patch and several concentric annular slots formed in the metal patch and wherein at least one annular slot of a radiating element has an electrical length that changes relative to another adjacent radiating element.

13. The reflector array according to claim 1, wherein the pattern comprises a radiating element comprising a complete metal patch and several consecutive radiating elements comprising a metal patch and several concentric annular slots formed in the metal patch, and wherein the annular slots have a length that changes independently or simultaneously from one radiating element to another adjacent radiating element.

14. The reflector array according to claim 1, wherein the radiating elements have a geometrical shape selected from a square shape, a rectangular shape, a circular shape, a hexagon shape or a cross shape with two perpendicular branches.

15. A reflector array antenna, comprising at least one reflector array according to claim 1.

16. A reflector array comprising a plurality of individual radiating elements arranged alongside one another and forming a reflecting surface and capable of reflecting incident waves with a phase variation law selected to provide a given coverage, wherein:

the individual radiating elements are produced using planar technology, each radiating element of the reflecting surface is selected from a set of predetermined consecutive radiating elements, called a pattern, the pattern being capable of creating a progressive phase variation of at least 360°, the radiating elements of the pattern have a radiating structure, of metal patch type and/or of radiating aperture type, that progressively changes from one radiating element to another adjacent radiating element, the change in the radiating structure including a succession of progressive growths of at least one metal patch and/or at least one aperture and appearances of at least one metal patch in an aperture and/or at least one aperture in a metal patch, and at least one radiating element includes an annular slot or several concentric annular slots and at least one short circuit means and/or capacitive means placed in at least one annular slot, the short circuit means and/or the capacitive means causing the electrical length of the slot to vary.

17. The reflector array according to claim 16, wherein the short circuit means is a metallization that divides up the slot at a point and over a length that are predetermined.

18. The reflector array according to claim 17, wherein the short circuit means is a micro-switch.

19. The reflector array according to claim 18, wherein each radiating element of the pattern includes at least one micro-switch and in that each micro-switch is positioned in an annular slot at a predetermined point and in a selected open or closed state, all the annular slots having the same width.

20. The reflector array according to claim 19, wherein the pattern comprises several consecutive radiating elements, each radiating element including several concentric annular slots, all the radiating elements comprising the same number of micro-switches positioned at the same points in the annular slots, the micro-switches of all the radiating elements of the pattern being configured in different states, and the states of the micro-switches varying progressively from one radiating element to another adjacent radiating element.

21. The reflector array according to claim 16, wherein the radiating elements have a geometrical shape selected from a square shape, a rectangular shape, a circular shape, a hexagon shape or a cross shape with two perpendicular branches.

22. A reflector array antenna, comprising at least one reflector array according to claim 16.

* * * * *